US008419377B2

(12) United States Patent
Hsu

(10) Patent No.: US 8,419,377 B2
(45) Date of Patent: Apr. 16, 2013

(54) PUMPING DEVICE HAVING A PRESSURE ADJUSTABLE FUNCTION

(75) Inventor: Mei-Chin Hsu, Tainan (TW)

(73) Assignee: Crafts & Carriers Taiwan Inc., Tainan (TW)

( * ) Notice: Subject to any disclaimer, the term of this patent is extended or adjusted under 35 U.S.C. 154(b) by 372 days.

(21) Appl. No.: 12/917,536

(22) Filed: Nov. 2, 2010

(65) Prior Publication Data

US 2012/0107146 A1 May 3, 2012

(51) Int. Cl.

| | |
|---|---|
| ***F04F 1/06*** | (2006.01) |
| ***F04B 9/14*** | (2006.01) |
| ***F04B 53/12*** | (2006.01) |
| ***B65D 83/00*** | (2006.01) |
| ***B65B 1/16*** | (2006.01) |

(52) U.S. Cl.

USPC ..... 417/118; 417/374; 417/545; 222/402; 141/67

(58) Field of Classification Search ..... 141/65, 141/67; 222/400.8, 401, 402, 400.7; 417/118, 417/374, 65, 545

See application file for complete search history.

(56) References Cited

U.S. PATENT DOCUMENTS 7,093,624 B2 * 8/2006 Chen ..... 141/65
7,367,366 B2 * 5/2008 Liao ..... 141/26

* cited by examiner

*Primary Examiner* — Peter J Bertheaud
*Assistant Examiner* — Bryan Lettman
(74) *Attorney, Agent, or Firm* — Alan Kamrath; Kamrath IP Lawfirm, P.A.

(57) ABSTRACT

A pumping device includes a barrel, a top cover mounted on an open top of the barrel, a cylinder mounted in the barrel and connected to the top cover, a piston movably mounted in the cylinder, a plurality of check valves mounted on the piston, an operation unit mounted on the top cover and connected with the piston, a connecting unit mounted in the barrel and connected between the barrel and the cylinder, and a pressure adjusting unit connected between the barrel and the top cover. Thus, when the air pressure in the receiving chamber of the barrel reaches a predetermined value, the pressure adjusting unit provides a pressure release function to partially release the air pressure in the receiving chamber of the barrel so as to ensure a safe operation of the pumping device.

17 Claims, 5 Drawing Sheets

PUMPING DEVICE HAVING A PRESSURE ADJUSTABLE FUNCTION

BACKGROUND OF THE INVENTION

1. Field of the Invention

The present invention relates to a pumping device and, more particularly, to a pumping device for pumping a fluid, such as a gas, liquid and the like.

2. Description of the Related Art

A conventional pumping device comprises a barrel, a top cover mounted on the top of the barrel, a cylinder mounted in the barrel, a piston movably mounted in the cylinder, and an operation unit mounted on the top cover and connected with the piston to move the piston relative to the cylinder. Thus, the piston is driven by the operation unit to pump a fluid into the cylinder and the barrel. However, a user can directly control the operation unit to operate the pumping device so that the pumping device does not have a security mechanism limit the operation unit so as to prevent the user from operating the pumping device improperly.

BRIEF SUMMARY OF THE INVENTION

In accordance with the present invention, there is provided a pumping device, comprising a barrel, a top cover mounted on an open top of the barrel and connected to an ambient environment, a cylinder mounted in the barrel and connected to the top cover, a piston movably mounted in the cylinder, a plurality of check valves mounted on the piston to move in concert with the piston, an operation unit mounted on the top cover and connected with the piston to move the piston relative to the cylinder, a connecting unit mounted in the barrel and connected between the barrel and the cylinder, and a pressure adjusting unit connected between the barrel and the top cover.

The primary objective of the present invention is to provide a pumping device having a pressure adjustable function.

According to the primary advantage of the present invention, when the air pressure in the receiving chamber of the barrel reaches a predetermined value, the pressure adjusting unit provides a pressure release function to partially release the air pressure in the receiving chamber of the barrel so as to ensure a safe operation of the pumping device.

According to another advantage of the present invention, the fluid is circulated in the receiving chamber of the barrel so that the pumping device is operated easily and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
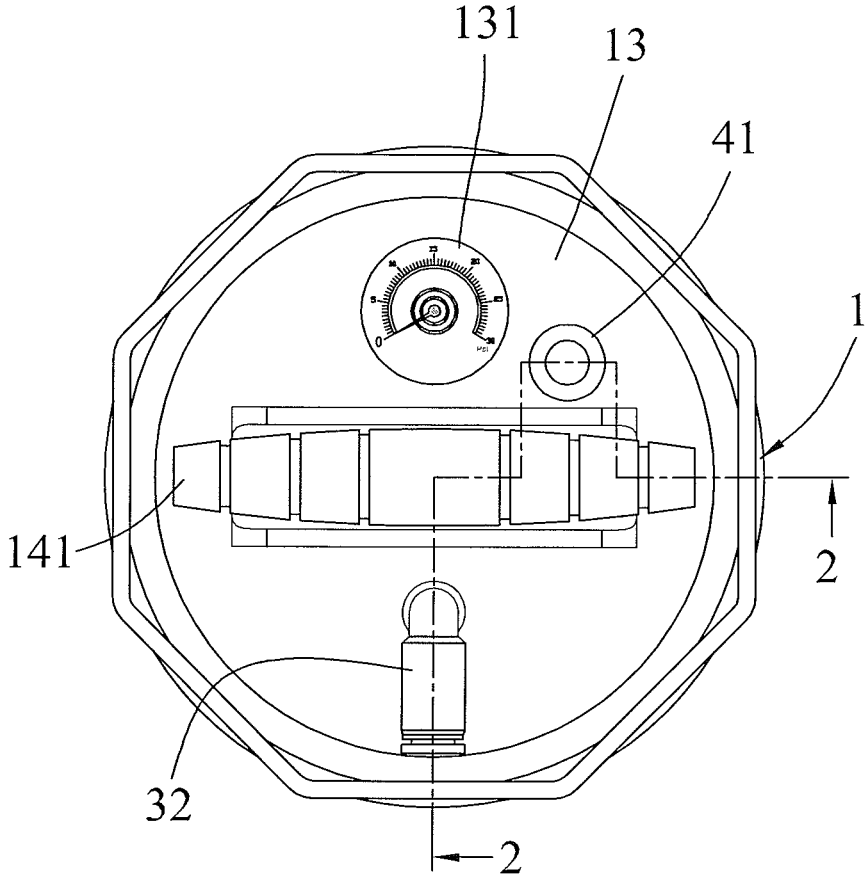
FIG. 1 is a top view of a pumping device in accordance with the preferred embodiment of the present invention.
Figure 2:
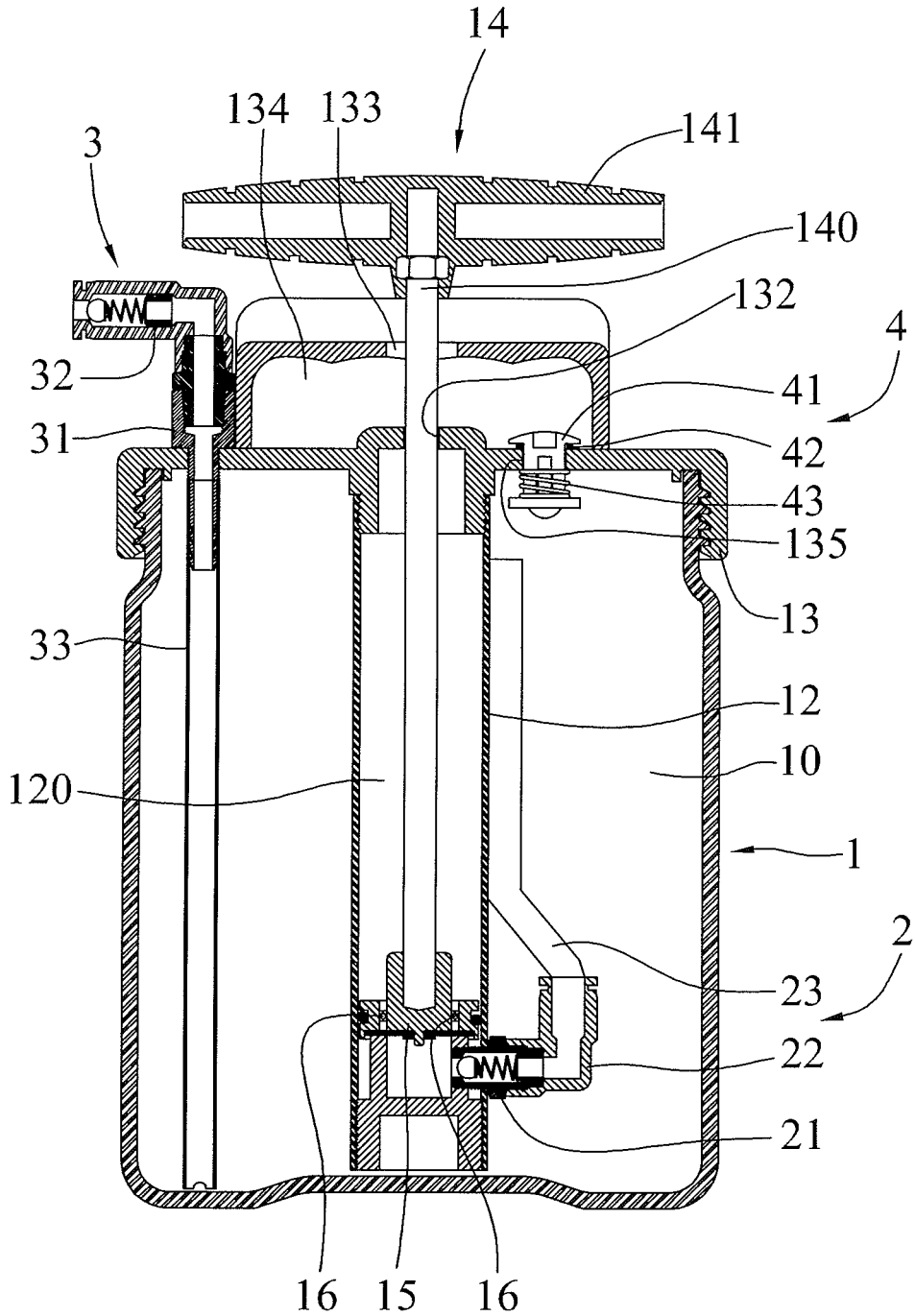
FIG. 2 is a cross-sectional view of the pumping device taken along line 2-2 as shown in FIG. 1.

Referring to the drawings and initially to FIGS. 1 and 2, a pumping device in accordance with the preferred embodiment of the present invention comprises a barrel 1, a top cover 13 mounted on an open top of the barrel 1 and connected to an ambient environment, a cylinder 12 mounted in the barrel 1 and connected to the top cover 13, a piston 15 movably mounted in the cylinder 12, a plurality of check valves 16 mounted on the piston 15 to move in concert with the piston 15, an operation unit 14 mounted on the top cover 13 and connected with the piston 15 to move the piston 15 relative to the cylinder 12, a connecting unit 2 mounted in the barrel 1 and connected between the barrel 1 and the cylinder 12, a pressure adjusting unit 4 connected between the barrel 1 and the top cover 13, and a delivery unit 3 mounted on the top cover 13 and connected to the barrel 1.

The barrel 1 has an inner portion provided with a receiving chamber 10 to receive the cylinder 12, the connecting unit 2, the pressure adjusting unit 4 and the delivery unit 3.

The top cover 13 has a bottom provided with a shaft hole 132 connected to the cylinder 12 and has a top provided with a pressure gauge 131 connected to the receiving chamber 10 of the barrel 1 to indicate the pressure data in the barrel 1. The top cover 13 has an inner portion provided with a release chamber 134 connected to the shaft hole 132 so that the shaft hole 132 of the top cover 13 is connected between the release chamber 134 of the top cover 13 and the cylinder 12. The top cover 13 has a top provided with a drain hole 133 connected between the release chamber 134 and the ambient environment. The top cover 13 has a side provided with a connecting hole 135 connected between the release chamber 134 and the receiving chamber 10 of the barrel 1.

The cylinder 12 is received in the receiving chamber 10 of the barrel 1 and has an upper end attach to the top cover 13. The cylinder 12 has an inner portion provided with a piston chamber 120 which has an upper end connected to the shaft hole 132 of the top cover 13. The piston 15 is movable in the piston chamber 120 of the cylinder 12. The check valves 16 are received in the piston chamber 120 of the cylinder 12. Each of the check valves 16 only allows the fluid in the piston chamber 120 of the cylinder 12 to flow from up to down.

The operation unit 14 includes a propeller shaft 140 movably mounted in the piston chamber 120 of the cylinder 12 and having a lower end connected with the piston 15 to move the piston 15 and an upper end protruding outward from the top cover 13, and a grip portion 141 mounted on the upper end of the propeller shaft 140 to move the propeller shaft 140 relative to the cylinder 12. The propeller shaft 140 of the operation unit 14 extends through the drain hole 133 and the shaft hole 132 of the top cover 13.

The connecting unit 2 is received in the receiving chamber 10 of the barrel 1 and includes a oneway valve 21 having a first end mounted on a lower end of the cylinder 12 and connected to the piston chamber 120 of the cylinder 12, a connector 22 having a first end connected with a second end of the oneway valve 21, and a conduit 23 having a first end connected with a second end of the connector 22 and a second end connected to the receiving chamber 10 of the barrel 1. The connector 22 of the connecting unit 2 has a substantially L-shaped profile.

The delivery unit 3 includes a joint 31 mounted on the top cover 13 and having a first end extended into the receiving chamber 10 of the barrel 1 and a second end protruding outward from the top cover 13, a pipe 33 mounted in the receiving chamber 10 of the barrel 1 and having a lower end connected to the receiving chamber 10 of the barrel 1 and an upper end connected with the first end of the joint 31, and a fitting 32 connected with the second end of the joint 31 and connected to a connecting pipe 34 which is connected with a container (not shown). The fitting 32 of the delivery unit 3 has a substantially L-shaped profile.

The pressure adjusting unit 4 is mounted on the top cover 13 and includes a pressure release piece 41 movably mounted in the connecting hole 135 of the top cover 13, a sealing gasket 42 mounted on the pressure release piece 41 and located between the release chamber 134 and the connecting hole 135 of the top cover 13 to interrupt a connection between the release chamber 134 and the connecting hole 135 of the top cover 13, and an elastic member 43 mounted on the pressure release piece 41 and biased between the pressure release piece 41 and the top cover 13 to push the sealing gasket 42 toward the connecting hole 135 of the top cover 13.

The pressure release piece 41 of the pressure adjusting unit 4 has an upper end extended into the release chamber 134 of the top cover 13 and a lower end extended into the receiving chamber 10 of the barrel 1. The sealing gasket 42 of the pressure adjusting unit 4 is received in the release chamber 134 of the top cover 13 and located above the connecting hole 135 of the top cover 13. The elastic member 43 of the pressure adjusting unit 4 is received in the receiving chamber 10 of the barrel 1 and located under the connecting hole 135 of the top cover 13.

Figure 3:
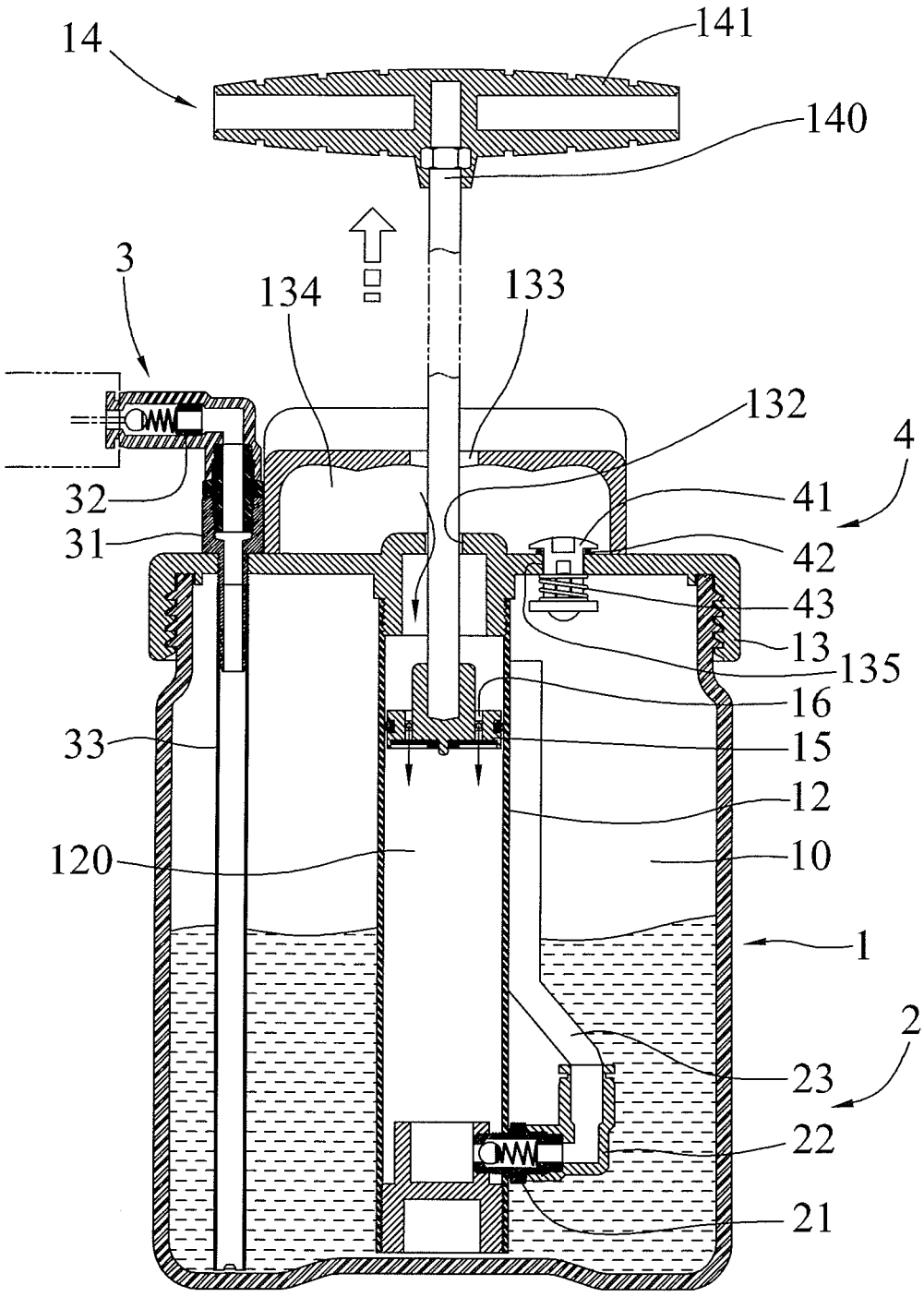
FIG. 3 is a schematic operational view of the pumping device as shown in FIG. 2 in use.
Figure 4:
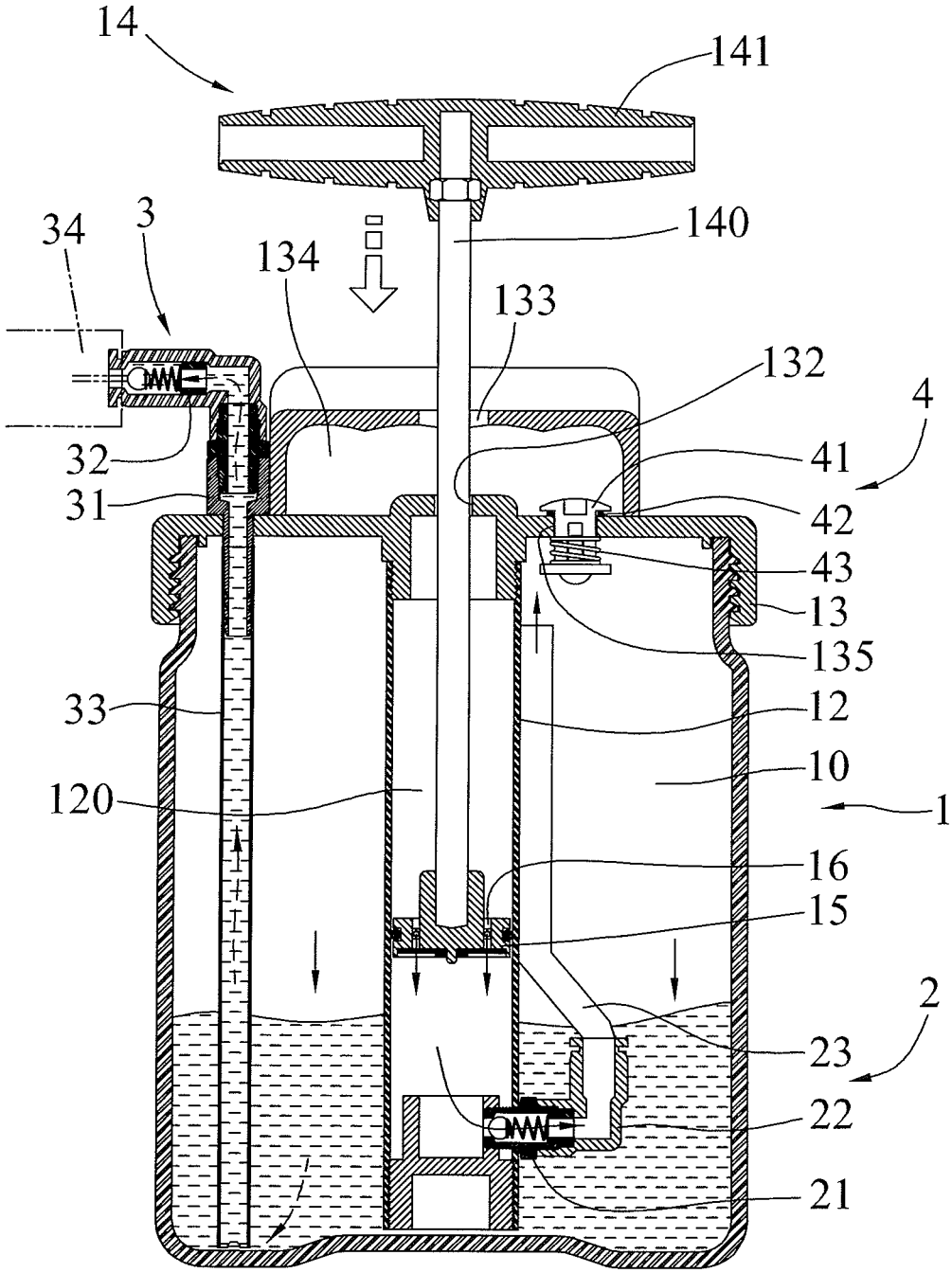
FIG. 4 is a schematic operational view of the pumping device as shown in FIG. 3 in use.

In operation, referring to FIGS. 3 and 4 with reference to FIG. 2, a liquid is filled into the receiving chamber 10 of the barrel 1. Thus, when the piston 15 is moved upward in the piston chamber 120 of the cylinder 12 by pulling the grip portion 141 of the operation unit 14, the piston chamber 120 of the cylinder 12 under the piston 15 is evacuated to form a vacuum suction force, so that the air in the ambient environment is drawn through the drain hole 133, the release chamber 134 and the shaft hole 132 of the top cover 13 into the piston chamber 120 of the cylinder 12 as shown in FIG. 3. Then, the air passes through the check valves 16 into the lower portion of the piston chamber 120 under the piston 15 so that the piston chamber 120 of the cylinder 12 is filled with the air. Then, when the piston 15 is moved downward in the piston chamber 120 of the cylinder 12 by pushing the grip portion 141 of the operation unit 14, the air in the piston chamber 120 of the cylinder 12 is compressed by the piston 15 to flow through the oneway valve 21, the connector 22 and the conduit 23 of the connecting unit 2 into the receiving chamber 10 of the barrel 1 as shown in FIG. 4. In such a manner, when the piston 15 is moved upward and downward in the piston chamber 120 of the cylinder 12 in a reciprocal manner, the air is introduced into the receiving chamber 10 of the barrel 1 successively to increase the air pressure in the receiving chamber 10 of the barrel 1 so that the liquid in the receiving chamber 10 of the barrel 1 is compressed by the air pressure to gradually flow through the pipe 33, the joint 31 and the fitting 32 of the delivery unit 3 into an external container. Thus, when the piston 15 is moved reciprocally in the piston chamber 120 of the cylinder 12, the liquid in the receiving chamber 10 of the barrel 1 is extracted outward from the barrel 1.

Figure 5:
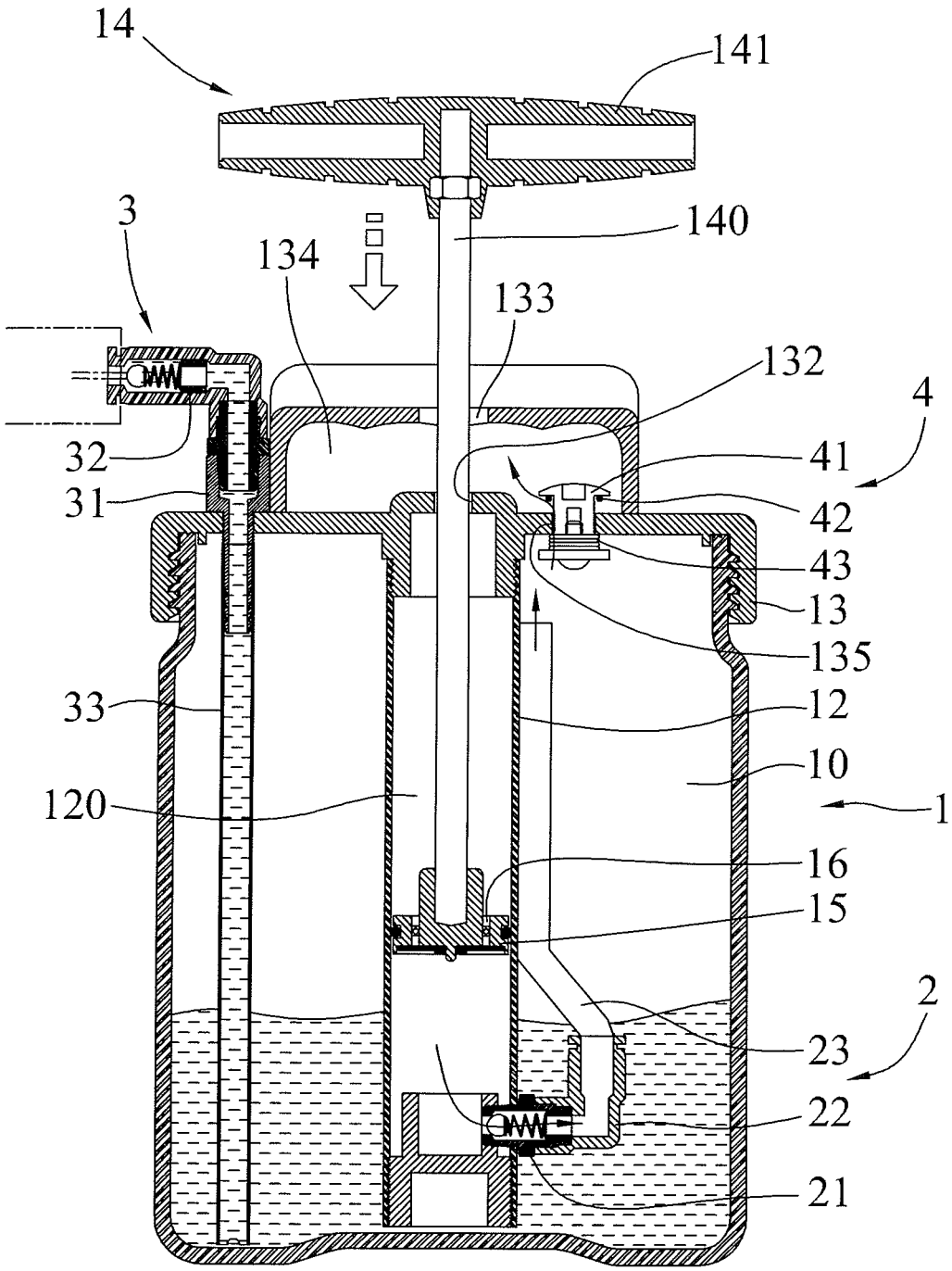
FIG. 5 is a schematic operational view of the pumping device as shown in FIG. 4 in use.

As shown in FIG. 5, when the air pressure in the receiving chamber 10 of the barrel 1 reaches a predetermined value, the pressure release piece 41 of the pressure adjusting unit 4 is pushed and moved upward by the air pressure to compress the elastic member 43 and to detach the sealing gasket 42 from the connecting hole 135 of the top cover 13 so as to connect the release chamber 134 of the top cover 13 to the receiving chamber 10 of the barrel 1 via the connecting hole 135 of the top cover 13 so that the air in the receiving chamber 10 of the barrel 1 partially passes through the connecting hole 135 into the release chamber 134 of the top cover 13 and is drained outward from the drain hole 133 of the top cover 13 to achieve a pressure release function.

Accordingly, when the air pressure in the receiving chamber 10 of the barrel 1 reaches a predetermined value, the pressure adjusting unit 4 provides a pressure release function to partially release the air pressure in the receiving chamber 10 of the barrel 1 so as to ensure a safe operation of the pumping device. In addition, the fluid is circulated in the receiving chamber 10 of the barrel 1 so that the pumping device is operated easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A pumping device, comprising:

a barrel;

a top cover mounted on an open top of the barrel and connected to an ambient environment;

a cylinder mounted in the barrel and connected to the top cover;

a piston movably mounted in the cylinder;

a plurality of check valves mounted on the piston to move in concert with the piston;

an operation unit mounted on the top cover and connected with the piston to move the piston relative to the cylinder;

a connecting unit mounted in the barrel and connected between the barrel and the cylinder; and a pressure adjusting unit connected between the barrel and the top cover, wherein the barrel has an inner portion provided with a receiving chamber;

the top cover has a bottom provided with a shaft hole connected to the cylinder;

the top cover has an inner portion provided with a release chamber connected to the shaft hole;

the top cover has a top provided with a drain hole connected between the release chamber and the ambient environment;

the top cover has a side provided with a connecting hole connected between the release chamber and the receiving chamber of the barrel; and the pressure adjusting unit includes:

a pressure release piece movably mounted in the connecting hole of the top cover;

a sealing gasket mounted on the pressure release piece and located between the release chamber and the connecting hole of the top cover to interrupt a connection between the release chamber and the connecting hole of the top cover; and an elastic member mounted on the pressure release piece and biased between the pressure release piece and the top cover to push the sealing gasket toward the connecting hole of the top cover.

2. The pumping device of claim 1, wherein the pressure release piece of the pressure adjusting unit has an upper end extended into the release chamber of the top cover and a lower end extended into the receiving chamber of the barrel.

3. The pumping device of claim 1, wherein the sealing gasket of the pressure adjusting unit is received in the release chamber of the top cover and located above the connecting hole of the top cover.

4. The pumping device of claim 1, wherein the elastic member of the pressure adjusting unit is received in the receiving chamber of the barrel and located under the connecting hole of the top cover.

5. The pumping device of claim 1, wherein the pressure adjusting unit is mounted on the top cover.

6. The pumping device of claim 1, wherein the shaft hole of the top cover is connected between the release chamber of the top cover and the cylinder.

7. The pumping device of claim 1, wherein the cylinder has an inner portion provided with a piston chamber which has an upper end connected to the shaft hole of the top cover;

the connecting unit includes:

a oneway valve having a first end mounted on a lower end of the cylinder and connected to the piston chamber of the cylinder;

a connector having a first end connected with a second end of the oneway valve; and a conduit having a first end connected with a second end of the connector and a second end connected to the receiving chamber of the barrel.

8. The pumping device of claim 7, wherein the connector of the connecting unit has a substantially L-shaped profile.

9. The pumping device of claim 1, wherein the pumping device further comprises:

a delivery unit mounted on the top cover and connected to the barrel.

10. The pumping device of claim 9, wherein the delivery unit includes:

a joint mounted on the top cover and having a first end extended into the receiving chamber of the barrel and a second end protruding outward from the top cover;

a pipe mounted in the receiving chamber of the barrel and having a lower end connected to the receiving chamber of the barrel and an upper end connected with the first end of the joint; and a fitting connected with the second end of the joint.

11. The pumping device of claim 10, wherein the fitting of the delivery unit has a substantially L-shaped profile.

12. The pumping device of claim 1, wherein the operation unit includes:

a propeller shaft movably mounted in the piston chamber of the cylinder and having a lower end connected with the piston to move the piston and an upper end protruding outward from the top cover; and a grip portion mounted on the upper end of the propeller shaft to move the propeller shaft relative to the cylinder.

13. The pumping device of claim 12, wherein the propeller shaft of the operation unit extends through the drain hole and the shaft hole of the top cover.

14. The pumping device of claim 1, wherein the top cover has a top provided with a pressure gauge connected to the receiving chamber of the barrel to indicate a pressure data in the barrel.

15. The pumping device of claim 1, wherein the connecting unit is received in the receiving chamber of the barrel.

16. The pumping device of claim 1, wherein the cylinder is received in the receiving chamber of the barrel;

the cylinder has an upper end attach to the top cover;

the piston is movable in the piston chamber of the cylinder.

17. The pumping device of claim 1, wherein the check valves are received in the piston chamber of the cylinder;

each of the check valves only allows the fluid in the piston chamber of the cylinder to flow from up to down.

* * * * *